United States Patent [19]

Rising

[11] Patent Number: 4,827,524

[45] Date of Patent: May 2, 1989

[54] MAGNETIC ATTACHMENT APPARATUS FOR EAR-LEVEL MICROPHONE

[75] Inventor: Rolf C. Rising, Kungbacka, Sweden

[73] Assignee: Diaphon Development AB, Molndal, Sweden

[21] Appl. No.: 181,222

[22] Filed: Apr. 13, 1988

[51] Int. Cl.[4] ..... H04R 29/00

[52] U.S. Cl. ..... 381/60; 73/585

[58] Field of Search ..... 381/68.3, 68.6, 169, 381/72, 60, 93; 73/585

[56] References Cited

U.S. PATENT DOCUMENTS

| | | | |
|---|---|---|---|
| 3,882,848 | 5/1975 | Klar et al. | 73/585 |
| 4,029,083 | 6/1977 | Baylor | 73/585 |
| 4,109,116 | 8/1978 | Victoreen | 381/93 |
| 4,412,096 | 10/1983 | Edgerton | 381/60 |
| 4,425,481 | 1/1984 | Mangold et al. | 381/68 |
| 4,548,082 | 10/1985 | Engebretson et al. | 73/585 |
| 4,628,907 | 12/1986 | Epley | 381/68.3 |
| 4,688,582 | 8/1987 | Heller et al. | 73/585 |

OTHER PUBLICATIONS

Madsen, "Insertion Gain Optimization", Hearing Instruments, vol. 37, No. 1, pp. 28–32 (1986).

Preves and Sullivan, "Sound Field Equalization for Real Ear Measurements with Probe Microphones", Hearing Instruments, vol. 38, No. 1, pp. 28–32 (1987).

Dillon and Murray, "Accuracy of Twelve Methods for Estimating the Real Ear Gain of Hearing Aids", Ear and Hearing, vol. 8, No. 1, Williams & Wilkins Co. (1987).

*Primary Examiner*—Forester W. Isen

*Attorney, Agent, or Firm*—Flehr, Hohbach, Test, Albritton & Herbert

[57] ABSTRACT

A device is disclosed for holding a probe tube in the ear canal of a person's ear. The device includes two members. The first member has a clip for clipping the first member to an ear lobe, and a first magnetic member coupled to the clip. The second member has a microphone coupled to a probe tube, and a housing for holding the probe tube at fixed position relative to the housing. The microphone generates amplified signals corresponding to sound conducted by the probe tube. In addition, a second magnetic member is coupled to the housing of the second member so that the second member can be held in a selected position relative to the first member by the magnetic attraction of the first and second magnetic members. The first and second magnetic members preferably each have a flat surface which enables the relative positions of the first and second members to be adjusted both angularly and laterally.

9 Claims, 5 Drawing Sheets

MAGNETIC ATTACHMENT APPARATUS FOR EAR-LEVEL MICROPHONE

The present invention relates to microphone apparatus for measuring sound levels in or near the ear canal, and particularly to a magnetic arrangement for attaching one or more ear-level microphones in a secure position.

BACKGROUND OF THE INVENTION

When a person is being fitted for a new hearing aid, such as the hearing aid disclosed in U.S. Pat. No. 4,425,481 (Mangold et al., 1984) it is often necessary to measure sound levels (commonly called the "sound pressure level," or SPL) in that person's ear canal in order to properly select parameter values for use in the hearing aid. Furthermore, in order to perform such sound level measurements, it is generally necessary to insert a probe tube into the person's ear canal (i.e., the external auditory meatus) for conducting sound from the measuring point to a microphone. The microphone detects the sound levels and generates an electrical signal which is transmitted to a system for measuring the detected sound levels. The receiving system uses the measured sound levels to calculate parameter values for use in a hearing aid.

While measuring the sound pressure level in a person's ear canal, it is important to control the position of the probe tube which conducts sound from the measuring point in the ear canal to a microphone. Variations in this position directly affect the measured sound level, which will affect the correctness of the measurements and the hearing aid gain parameters calculated using those measurements.

Another aspect of measuring sound pressure levels in the ear canal is the use of a reference microphone. Reference microphones are used in a variety of standard measurement methods, including the methods known as the "comparison method", the "pressure method" and the "modified pressure method". The comparison method requires that the test microphone and the reference microphone, employed to measure the free field sound pressure, be placed simultaneously at two acoustically equivalent points in the sound field, i.e., in each of the two ear canals. The pressure method uses a pressure-calibrated reference microphone at a point close to the entry of the ear canal to control the input sound pressure level produced by a sound source, e.g., a loudspeaker, to eliminate diffraction effects. Modified pressure methods differ from the pressure method only in that the reference microphone is placed near the earlobe rather than at the precise location of the opening of the ear canal. These methods are described by Poul B. Madsen, "Insertion gain optimization," Hearing Instruments, vol. 37, no. 1, pp 28–32 (1986); David A. Preves and Roy F. Sullivan, "Sound field equalization for real ear measurements with probe microphones," Hearing Instruments, vol. 38, no. 1, pp 28–32 (1987); and Harvey Dillon and Narelle Murray, "Accuracy of Twelve Methods for Estimating the Real Ear Gain of Hearing Aids," Ear and Hearing, vol. 8, no. 1, Williams & Wilkins Co. (1987). The aforementioned references are hereby incorporated by reference in their entirety.

The preferred embodiment of the present invention includes a reference microphone in a position appropriate for use in a modified pressure method of measuring sound pressure levels in the ear canal.

The prior art includes a number of systems for holding a probe tube in a fixed position in a person's ear canal. These systems generally use hooks over the pinna (i.e., the external ear), and/or headbands encircling all or part of the head. Furthermore, these systems are generally cumbersome, and are too limited in flexibility to be easily used with all patients, or require elaborate mechanical arrangements (e.g., gimbals) in order to change the position of the probe tube.

It is therefore an object of the present invention to provide an improved ear probe holding apparatus which is mechanically simple and provides improved capabilities in terms of positioning and maintaining the position of a probe tube in a person's ear canal. Another object of the present invention is to provide an ear probe holding apparatus that also holds a reference microphone in close proximity to the opening of the ear canal so that the reference microphone can be used to control the sound pressure level close to the opening of the ear canal.

SUMMARY OF THE INVENTION

In summary, the present invention is a device for holding a probe tube in an ear canal. The device includes a first member that includes a clip for attaching the first member to a person's ear, and a first magnetic member coupled to the clip. A second member has a microphone coupled to a probe tube (called the probe tube microphone), and a housing for holding the probe tube at fixed position relative to the housing. The microphone generates amplified signals corresponding to sound conducted by the probe tube. In addition, a second magnetic member is coupled to the housing of the second member so that the second member can be held in a selected position relative to the first member by the magnetic attraction of the first and second magnetic members. Thus the placement of the two members determines the position of the probe tube in a person's ear canal, and the probe tube is held in its selected position because the whole arrangement is anchored to the person's ear lobe.

Another aspect of the present invention is to have a second microphone, called a reference microphone, in close proximity to the ear canal, and in the same assembly as the probe tube microphone. The probe tube microphone and the reference microphone are both enclosed in the housing of the second member, with the two microphones separated by rubber gaskets to prevent cross coupling of the microphones. Since the entire arrangement is anchored to the ear lobe, the reference microphone is held in close proximity to the opening of the ear canal.

In a preferred embodiment the first and second magnetic members each have a flat surface which enables the positions of the first and second members to be adjusted both laterally and angularly. More particularly, the first magnetic member is coupled to the clip so that, when the first member is clipped to an ear lobe, the flat surface of the first magnetic member faces away from the ear lobe. The second member's magnetic member is placed face to face with the first member's magnetic member, and the relative positions of the two are adjust merely by sliding one relative to the other.

Another feature of the preferred embodiment is that the wire used for transmitting the amplified signals generated by the microphone is held in place by the first member so that small movements of the wire will not change the position of the probe tube in the ear canal.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENT

Figure 1:
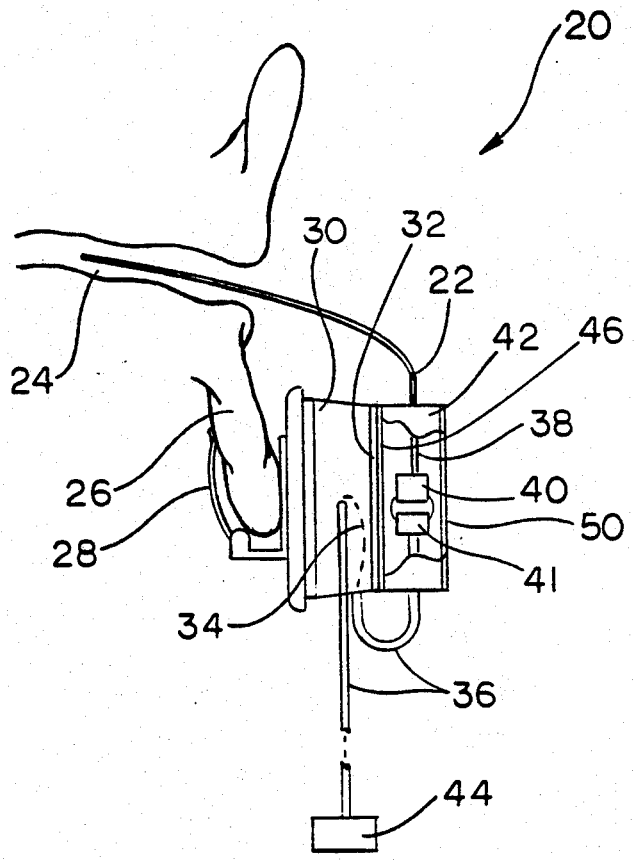
FIG. 1 schematically shows a device for holding a probe tube in an ear canal, and a reference microphone in close proximity to the ear canal.
Figure 2:
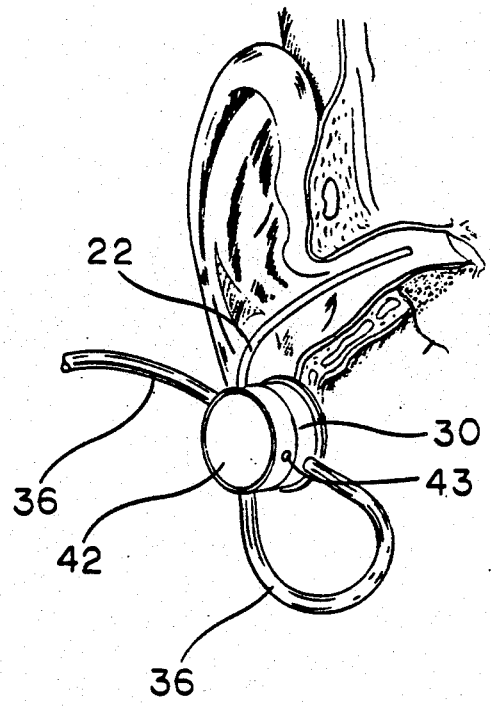
FIG. 2 is a perspective view of the device shown in FIG. 1.
Figure 3:
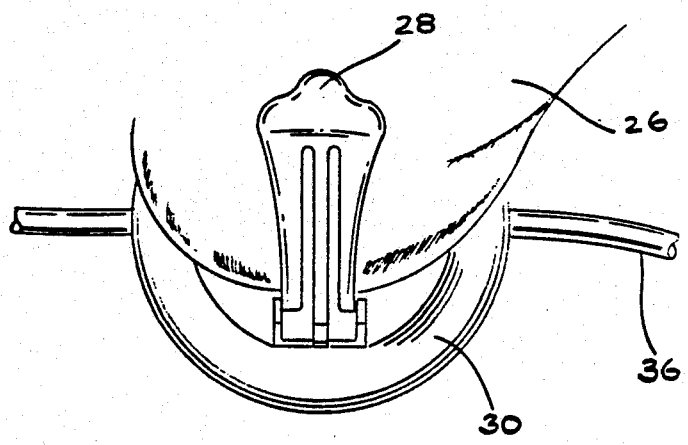
FIGS. 3, 4 and 5 show a member for attaching the device of FIG. 1 to a person's outer ear.

Referring to FIGS. 1 and 2, there is shown an arrangement or device 20 for holding a flexible plastic probe tube 22 in an ear canal 24. As shown in FIG. 3, the device 20 is attached to a person's ear lobe 26 by an ear clip 28. In the preferred embodiment, the ear clip 28 is similar in shape and function to the ear clips used in women's jewelry for unpierced ears.

Figure 5:
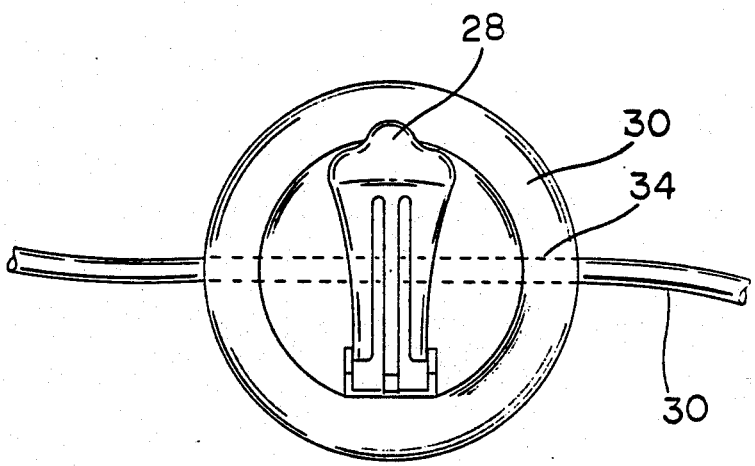
Figure 4:
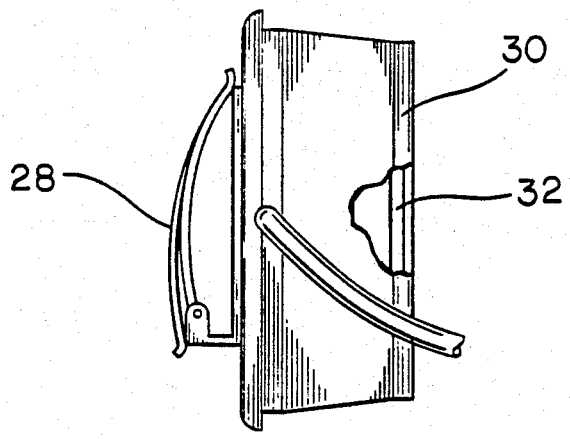

Referring to FIG. 4, the clip 28 is affixed to a cylindrically shaped plastic carrier 30 for a disk shaped magnet 32. As shown in FIGS. 1–3, the magnet 32 faces away from the ear lobe 26. In addition, as shown in FIGS. 1 and 5, the plastic carrier 30 contains an aperture 34 for holding a wire 36.

Figure 6:
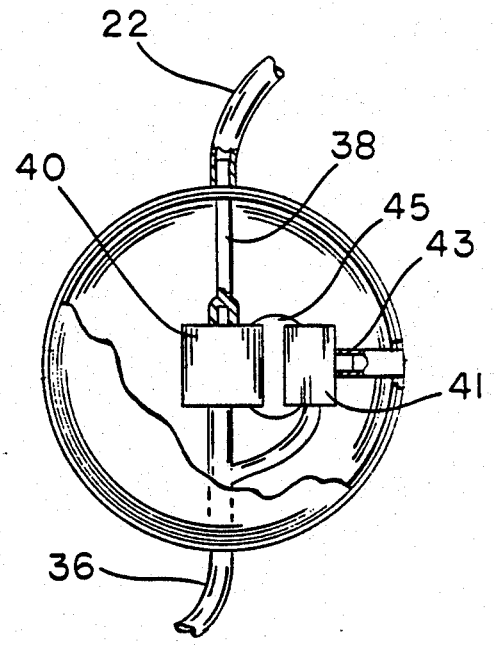
FIG. 6 shows a second member of the device, which holds a microphone.

Referring now to FIGS. 1, 2 and 6, the probe tube 22 is coupled by a hollow steel tube 38 to a microphone 40 housed in a cylindrically shaped microphone case 42. Microphone 40 is sometimes referred to as the probe tube microphone. The fixed placement of the probe tube microphone 40 and steel tube 38 in the case 42 anchors the flexible probe tube 22.

The purpose of the probe tube microphone 40 is to detect and amplify the acoustical sounds signals (i.e., sound pressure levels) conducted by the probe tube 22 to the microphone 40, and to generate an electronic signal corresponding to the sound signals conducted by the probe tube. The resulting electronic signals are transmitted by wire 36 to a system 44 for measuring the detected sound levels and generating a set of corresponding hearing aid parameters.

A second microphone 41, called the reference microphone is also housed in the microphone case 42. As shown in FIG. 2, the microphone case 42 has an aperture 43 so that the reference microphone can detect sound pressure levels outside the microphone case 42, in the vicinity of the opening of the ear canal. The tube 38 for the first microphone and the aperture 43 for the reference microphone are oriented so that the aperture 43 faces forward, toward the opening of the ear canal, when the tube 38 is oriented for holding the probe tube 22 inside the ear canal 24.

The reference microphone 41 is acoustically isolated from the probe tube microphone by rubber gaskets 45, preferably made from silicone rubber. The purpose of the reference microphone 41 is to detect the sound pressure level generated by a controlled loudspeaker in the vicinity of the opening of the ear canal 24, which is also close to the location of a hearing aid microphone when a hearing aid is being used. The sound pressure level detected by the reference microphone is then used to control the sound pressures generated by the loudspeaker, using conventional feedback control techniques.

In the preferred embodiment, wire 36 actually comprises a set of wires: two shielded cables, each having a shield serving as the common or signal ground voltage source and a wire inside the shield for transmitting electronic signals from the corresponding microphone 40 or 41, plus one wire for conveying power (e.g., at 10 volts) from the measurement system 44 to both of the microphones 40 and 41.

It should be noted that the wire 36 is held by the plastic carrier 30 to isolate the probe tube 22 from movements of the wire 36. In other words, the wire 36 is held by the plastic carrier so that small movements of the wire 36 will not change the position of the microphone case 42 relative to the plastic carrier 30 or the ear canal 24.

An important feature of the microphone case 42 is that it holds a disk shaped magnetic member 46 (in this case, a steel plate) which is magnetically attracted to the magnet 32 in the plastic carrier 30. As will be described in more detail below, the magnetic attraction of the two magnetic members 32 and 46 enables the user to both secure and easily adjust the position of the probe tube 22 in the ear canal 24.

A feature of the preferred embodiment is that the microphone case 42 also holds a second magnetic member 50 (i.e., another steel disk) on the end of the case 42 which is opposite the other magnetic member 46 in the case. To use the second magnetic member, the entire magnetic case 42 is disengaged from the plastic clip carrier 30, and the magnetic case is flipped or rotated so that the second magnetic member 50 faces or is brought into contact with the magnet 32. Depending on whether the device 20 is being used with the left or the right ear, it will be easier to properly position the probe tube 22 in an ear canal 24 when one or the other of these two magnetic members 46 or 50 is coupled to the magnet 32. Providing two magnetic members 46 and 50 also enables the aperture 43 for the reference microphone to face forward, toward the opening of the ear canal, regardless of which ear the device 20 is being used with. It should also be noted that the wire 36 can be rotated inside the aperture 34 in the plastic carrier 30 to facilitate proper positioning of the probe tube 22.

Figure 7:
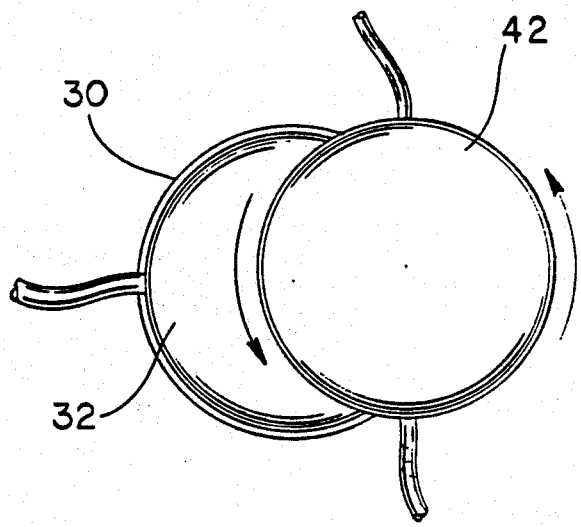
FIGS. 7 and 8 show how the apparatus provided by the present invention can be used to adjust the position of a probe tube by angular and lateral adjustments of the position of the microphone holding member.
Figure 8:
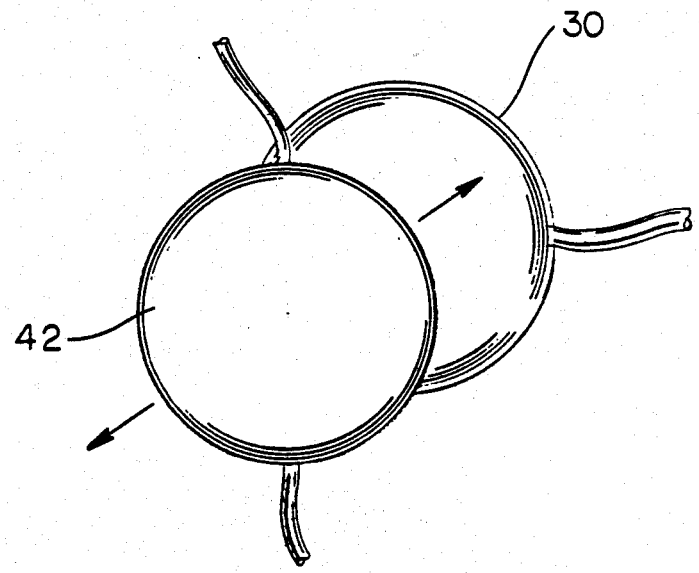

Referring to FIGS. 2, 7 and 8, the position of the probe tube 22 in an ear canal 24 is secured by clipping the plastic carrier 30 to the subject's ear lobe, placing one of the magnetic members of the microphone case 42 against the magnet 32, placing the probe tube 22 in the ear canal 24, and then positioning the microphone case 42 relative to the subject's ear canal. The microphone case 42 is held in its selected position by the magnetic attraction of the magnetic members in the carrier 30 and the microphone case 42.

Referring to FIGS. 7 and 8, the flat surfaces of the magnetic members in the carrier 30 and the microphone case 42 enable the positions of the carrier 30 and the case 42 to be adjusted both angularly (as shown in FIG. 7) and laterally or translationally (as shown in FIG. 8).

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

For instance, while it is important is that the two members 30 and 42 both contain magnetic elements for holding the two members 30 and 42 at a specified relative position, the positions of the magnetic members 32 and 46 could be reversed, with the magnet 32 being carried by the microphone case 42, and the steel plate 46 being carried by the plastic carrier 30.

What is claimed is:

1. A device for holding a probe tube in the ear canal of a person's ear, comprising:

a first member having clip means for attaching said first member to a person's ear, and a first magnetic member coupled to said clip means;

a second member having a microphone coupled to a probe tube, and housing means for holding one end of said probe tube at a fixed position relative to said housing means;

and a second magnetic member coupled to the housing of said second member, said first and second magnetic members being shaped and magnetized so that said second member can be held in a selected position relative to said first member by the magnetic attraction of said first and second magnetic members;

whereby one end of said probe tube is held at a fixed location in said ear canal when said second magnetic member and the other end of said probe tube are held in corresponding positions by the magnetic attraction of said first and second magnetic members while said device is attached to said person's ear by said clip means.

2. The device set forth in claim 1, wherein said first and second magnetic members each have a flat surface which enables the positions of said first and second members to be adjusted both angularly and laterally.

3. The device set forth in claim 2, wherein said first magnetic member is coupled to said clip means so that, when said first member is clipped to an ear lobe, said flat surface of said first magnetic member faces away from the ear lobe.

4. The device set forth in claim 1, wherein said second member includes a second microphone for detecting sound pressure levels in the vicinity of the opening of the ear canal of said person's ear.

5. The device set forth in claim 1, wherein said second member includes a second microphone, acoustically isolated from said microphone coupled to said probe tube, for detecting sound pressure levels in the vicinity of the opening of the ear canal of said person's ear.

6. A device for holding a probe tube in the ear canal of a person's ear, comprising:

a first member having clip means for clipping said first member to the ear lobe of a person's ear, and a first magnetic member coupled to said clip means;

a second member having a microphone coupled to a probe tube, including housing means for holding one end of said probe tube at a fixed position relative to said housing means when the other end of said probe tube is in the ear canal of said person's ear, said microphone including amplifying means for generating amplified signals corresponding to sound conducted by said probe tube to said microphone;

and a second magnetic member coupled to the housing of said second member so that said second member can be held in a selected position relative to said first member by placing said second magnetic member at a corresponding position, wherein said second member is held in said selected position and said probe tube is held in a corresponding position by the magnetic attraction of said first and second magnetic members.

7. The device set forth in claim 6, said amplifying means having means for generating electronic signals corresponding to sound conducted by said probe tube to said microphone; said amplifying means being coupled to signal transmission means for transmitting said electronic signals.

8. The device set forth in claim 7, wherein said signal transmission means comprises wire means for conveying electrical signals, and said first member includes means for holding said wire means so that small movements of said wire means will not change the relative positions of said first and second members.

9. The device set forth in claim 7, wherein said second member includes a second microphone for detecting sound pressure levels in the vicinity of the opening of the ear canal of said person's ear.

* * * * *